US005203662A

United States Patent [19]

Theurer et al.

[11] Patent Number: 5,203,662

[45] Date of Patent: Apr. 20, 1993

[54] TRACK-BOUND FREIGHT CAR FOR BULK MATERIAL

[75] Inventors: Josef Theurer, Vienna; Friedrich Oellerer, Linz; Manfred Brunninger, Altenberg, all of Austria

[73] Assignee: Franz Plasser Bahnbaumaschinen-Industriegesellschaft m.b.H., Vienna, Austria

[21] Appl. No.: 857,091

[22] Filed: Mar. 20, 1992

Related U.S. Application Data

[63] Continuation of Ser. No. 620,368, Jan. 28, 1990, abandoned.

[30] Foreign Application Priority Data

Dec. 1, 1989 [EP] European Pat. Off. ..... 89122171

[51] Int. Cl.[5] ..... B65G 67/10

[52] U.S. Cl. ..... 414/339; 414/343; 414/508; 414/528

[58] Field of Search ..... 414/339, 340, 343, 345, 414/346, 352, 353, 508, 519, 520, 528, 502; 104/2; 105/372, 378; 296/36

[56] References Cited

U.S. PATENT DOCUMENTS

| | | | |
|---|---|---|---|
| 3,420,211 | 1/1969 | Hartvickson | 414/508 X |
| 3,648,859 | 3/1972 | Johnson | 414/528 X |
| 3,900,392 | 8/1975 | Speno et al. | 414/345 X |
| 4,051,960 | 10/1977 | Raksanyi | 414/519 X |
| 4,576,538 | 3/1986 | Theurer et al. | 414/339 |
| 4,613,182 | 9/1986 | Stone | 105/378 X |
| 4,655,916 | 4/1987 | Schesinger | 414/345 X |
| 4,809,617 | 3/1989 | Theurer et al. | 104/2 X |
| 4,919,583 | 4/1990 | Speakman, Jr. | 414/520 X |
| 4,923,355 | 5/1990 | Mancini | 414/343 X |
| 5,099,766 | 3/1992 | Whitaker, Jr. | 104/2 |

FOREIGN PATENT DOCUMENTS

| | | | |
|---|---|---|---|
| 8813859 | 2/1989 | Fed. Rep. of Germany . | |
| 2541638 | 8/1984 | France | 414/528 |
| 0749203 | 5/1956 | United Kingdom | 414/520 |

*Primary Examiner*—Michael S. Huppert
*Assistant Examiner*—James Keenan
*Attorney, Agent, or Firm*—Collard & Roe

[57] ABSTRACT

A track-bound freight car comprising a box for storing bulk material, the box having a bottom portion and comprising a longitudinally extending conveyor in the bottom portion of the box, a carrier frame bearing the conveyor, the conveyor and carrier frame having a width exceeding the width of the bottom portion of the box car, and two longitudinally extending side walls, at least a lower portion of the side walls adjacent the conveyor being pivotal about a longitudinally extending axis away from the conveyor, or a lower side wall portion being detachable.

7 Claims, 1 Drawing Sheet

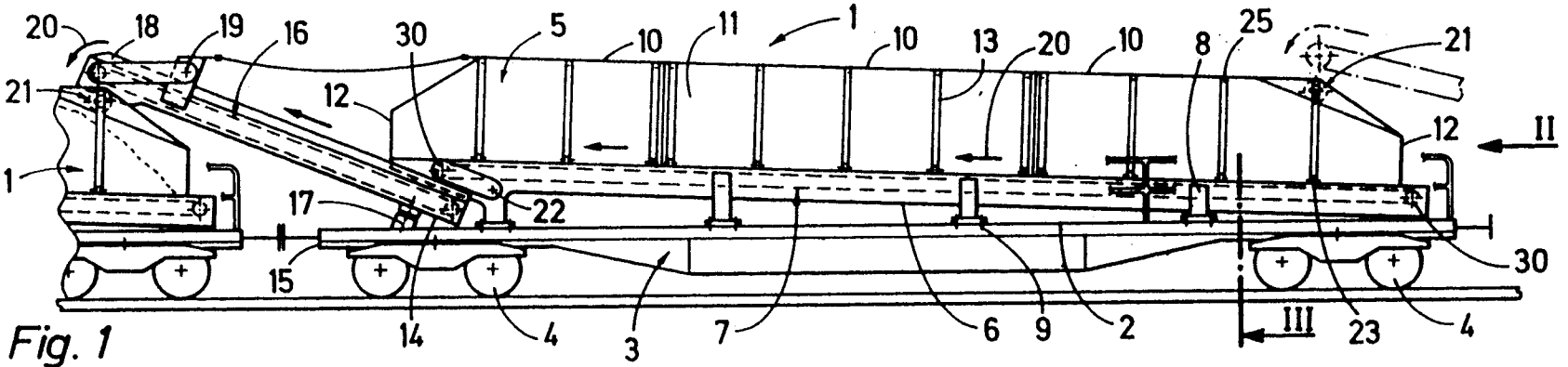
Fig. 1
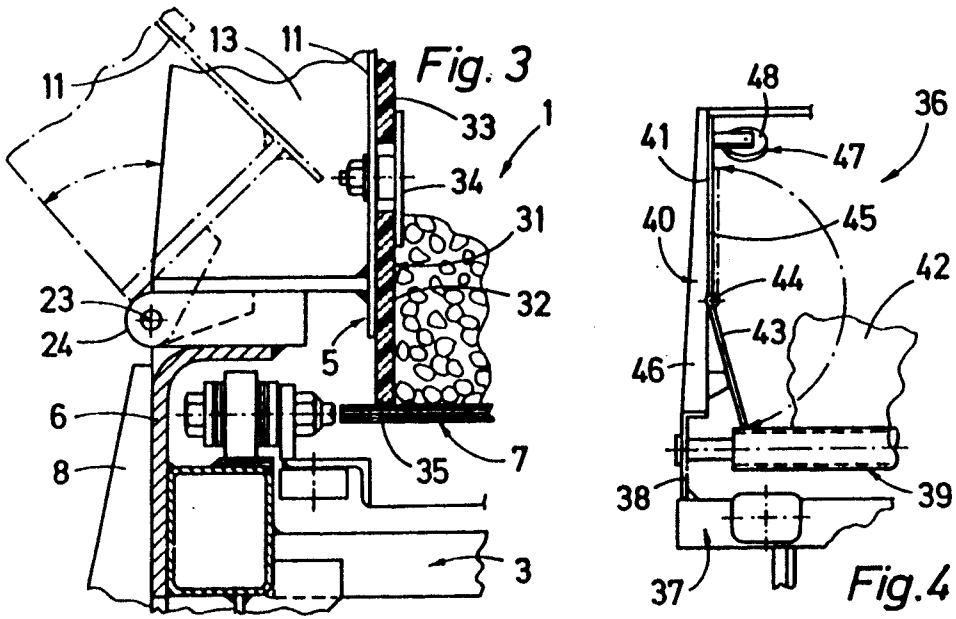
Fig. 3
Fig. 4
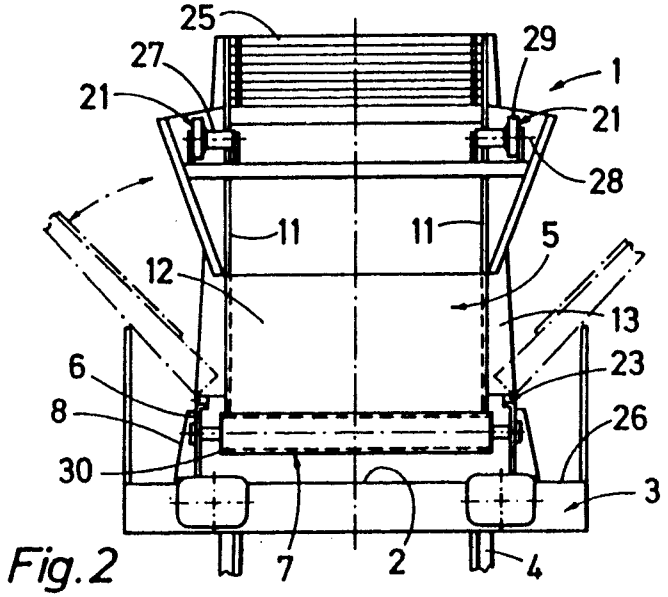
Fig. 2

TRACK-BOUND FREIGHT CAR FOR BULK MATERIAL

CROSS-REFERENCE TO RELATED APPLICATION

This is a continuation of our copending application Ser. No. 07/620,368, filed Nov. 28, 1990, now abandoned.

BACKGROUND OF THE INVENTION

1. Field of the Invention

The present invention relates to a track-bound freight car comprising a box for storing bulk material, the box having a bottom portion and two longitudinally extending side walls, and comprising a longitudinally extending conveyor in the bottom portion of the box car.

2. Description of the Prior Art

U.S. Pat. No. 4,576,538, dated Mar. 18, 1986, discloses a train comprised of a series of such coupled freight cars. The bulk material may be stored and transported in the cars, and the bottom conveyors in the successive cars may be operated to convey the bulk material to adjoining delivery conveyor bands which bridge the successive cars and move the bulk material from one car to the next. Each car has its own motor for powering the conveyor drives, and a central control on a ballast rehabilitation machine controls the operation of all drives. The delivery conveyor bands project from one of the ends of the ballast rehabilitation machine and of the freight cars to reach the boxes of the adjacent cars so that the bulk material may be readily transported from the ballast rehabilitation machine to selected freight cars in the train. The successive bottom conveyors and delivery conveyor bands may be operated at high speed to transport the ballast from the ballast rehabilitation machine to the last car in the train where the bottom conveyor is driven slowly to store the ballast in the box of the last car while its delivery conveyor band stands still. As soon as the box in the last car is filled, its bottom conveyor and the preceding delivery conveyor band are stopped, and the bottom conveyor in the preceding car is slowed down for filling the box in the preceding car. This operation is repeated until all the boxes are full.

German utility model No. G 88 13 859.3, whose registration was published on Feb. 2, 1989, discloses a track-bound box car for transporting bulk material, which comprises a bottom conveyor projecting beyond a leading end of the car and ascending rearwardly. In this way, the bottom conveyor directly delivers bulk material conveyed thereby to a preceding box car. The bottom conveyor band is arranged fully within the box which is supported on the frame of the freight car.

SUMMARY OF THE INVENTION

It is the primary object of this invention to provide a freight car of the indicated type whose construction is greatly simplified.

The above and other objects are accomplished according to the invention with a track-bound freight car comprising a box for storing bulk material, the box having a bottom portion and comprising a longitudinally extending conveyor in the bottom portion of the box car, a carrier frame bearing the conveyor, the conveyor and carrier frame having a width exceeding the width of the bottom portion of the box, and two longitudinally extending side walls, at least a lower portion of the side walls adjacent the conveyor being pivotal about a longitudinally extending axis away from the conveyor.

This special arrangement has the advantage that a bulk material holding box with four planar walls can be used on a freight car without a bottom wall. Because the bottom conveyor is wider than the bottom portion of the box, a dependable seal between the bottom conveyor and the box walls may be provided without additional structures, simply by arranging the lower ends of the box walls immediately adjacent the conveyor. The pivotal arrangement of the side walls enables the lower portions thereof to be swung away so that the wider conveyor may be readily and rapidly replaced when it is worn out. It may be desirable to make only the lower side wall portions adjacent the conveyor pivotal while the upper side wall portions remain stationary, which reduces the required pivoting forces required to swing the lower side wall portions away from the conveyor during a replacement operation.

According to a preferred feature of the present invention, the lower portion of each side wall is pivotally mounted on the carrier frame. This will firmly anchor the side walls to the carrier frame of the bottom conveyor and, on the other hand, will enable the lower side wall portions to be detached from the lateral edges of the bottom conveyor so that a worn conveyor may be removed and a new conveyor installed.

According to one embodiment of the invention, the carrier frame has a respective bearing carried by a respective one of the axes spaced transversely from a respective one of the side walls. This enables a relatively small pivotal movement of the lower side wall portions to detach these side wall portions from the lateral edges of the bottom conveyor, which project beyond the side walls of the box, so that the entire bottom conveyor becomes readily accessible.

Preferably, the side walls have longitudinally spaced support bars at the outsides thereof, the support bars extending perpendicularly to the conveyor and being carried by the bearings. Such support bars make it possible to use simple flat plates as side walls because they serve as reinforcements and brace the plates so that they will be firmly connected to the carrier frame despite the hinged arrangement.

The construction of the side walls will be considerably simplified and undue vibrations during pivoting will be avoided if the side walls are comprised of several, preferably three, wall parts arranged longitudinally adjacent each other.

According to another preferred feature, the freight car further comprises transversely extending bracing bars detachably connecting the longitudinally extending side walls at upper portions thereof. This enables the pivotal side walls to be braced in a vertical position so that they may stand up under the lateral pressure of the bulk material filling the box.

Preferably, the side walls extend in vertical planes extending perpendicularly with respect to the conveyor and have lower ends spaced therefrom, and the box further comprises a lining of an elastic material at the inside of the side walls between the side walls and the conveyor. The elastic lining will protect the relatively thin side walls from wear and the spacing between the lower side wall ends and the conveyor will prevent undue friction between the moving conveyor and the side walls. Each lining may have a separate lower portion adjacent the conveyor and projecting from the lower side wall ends, the lower lining portion being displaceable towards the conveyor. In this way, it is possible in a very simple manner to eliminate any gap between the lining and the conveyor due to wear of the lining.

Without requiring any further adaptation, a flat-bed car having a loading platform may be used if the carrier frame comprises supports projecting downwardly from the carrier frame and is detachably connected to the loading platform for supporting the carrier frame and conveyor on the loading platform. In this manner, regular flat-bed cars may be readily retrofitted with the boxes of the present invention.

The supports are preferably of different lengths for supporting the carrier frame and the conveyor in a longitudinally extending plane extending obliquely with respect to the loading platform from a higher end to a lower end, and a delivery conveyor band projects beyond an end of the loading platform adjacent the higher end and ascends from below the higher end to an upper end. The oblique position of the carrier frame enables the lower delivery conveyor band end to be positioned below the higher bottom conveyor end without requiring any structural change in the loading platform of the flat-bed car.

If the delivery conveyor band is pivotal about an axis enclosing an angle with the obliquely extending plane, the upper delivery band conveyor band end may be readily centered in a track curve above the box of an adjacent car.

According to another preferred embodiment, a centering device is arranged at an end of the box adjacent the lower end for engaging the pivotal delivery conveyor band of a like freight car adjacent thereto and/or at the upper end of the projecting delivery conveyor band for centering the upper delivery conveyor band end over the box of a like freight car adjacent thereto. Such a centering device will assure automatic centering of the delivery conveyor band above the box of the adjacent car in track curves. The centering device may comprise two support rollers transversely spaced from each other a distance corresponding at least to the width of the delivery conveyor band and rotatably mounted on the side walls of the box about transversely extending, horizontal axes, each support roller having a flange at an outer end thereof and each flange having a diameter exceeding the diameter of the support roller. Such support rollers will assure a dependable centering of the delivery conveyor band while at the same time also supporting it so as to relieve the pressure on the lower bearing of the conveyor band. The outer flanges on the support rollers will assure proper centering even in sharp curves. In another embodiment, the centering device may comprise two rollers mounted on the side walls of the box and extending in a plane extending parallel to that of the delivery conveyor band, the rollers being transversely spaced from each other a distance corresponding at least to the width of the delivery conveyor band. This provides a very simple structure and substantially eliminates any friction between the delivery conveyor band and the box end of the adjacent car.

The box and the carrier frame may have a width less than the width of the loading platform whereby a longitudinally extending footpath is formed along the sides of the loading platform. Such footpaths enable operating personnel to move along the cars and from one car to the other without obstructing the operation or exposing themselves to danger.

BRIEF DESCRIPTION OF THE DRAWING

The above and other objects, advantages and features of this invention will become more apparent from the following detailed description of certain now preferred embodiments thereof, taken in conjunction with the accompanying, somewhat schematic drawing wherein FIG. 1 is a side elevational view of a freight car according to the invention, fragmentarily showing a like adjacent car coupled thereto to indicate a freight train comprised of a series of such cars;

FIG. 2 is an enlarged end view of the freight car of FIG. 1, seen in the direction of arrow II;

FIG. 3 is a similarly enlarged fragmentary sectional view of one side wall of the box, along line III of FIG. 1; and FIG. 4 is a like section illustrating another embodiment wherein only the lower side wall portion is pivotal.

DETAILED DESCRIPTION OF PREFERRED EMBODIMENTS

As shown in FIGS. 1 to 3, track-bound freight car 1 comprises box 5 for storing bulk material, the box having a bottom portion and comprising longitudinally extending conveyor 7 in the bottom portion of the box carrier frame 6 bearing the conveyor, the conveyor and carrier frame having a width exceeding the width of the bottom portion of the box, as shown in FIG. 2. The box 5 has two longitudinally extending side walls 11 and two transversely extending end walls 12 connecting the side walls, and according to the invention, at least a lower portion of side walls 11 adjacent conveyor 7 is pivotal about longitudinally extending axis 23 away from the conveyor. As illustrated in FIG. 2, the lower portion of each side wall 11 is pivotally mounted on carrier frame 6.

FIG. 3 shows an embodiment wherein carrier frame 6 has a respective bearing 24 carried by a respective one of axes 23 spaced transversely from a respective side wall 11. The side walls have longitudinally spaced support bars 13 at the outsides thereof, the support bars extending perpendicularly to conveyor 7 and being carried by bearings 24. Bearing 24 is affixed, on the one hand, to an upper part of carrier frame 6 and, on the other hand, to a lower end of a support bar 13 at a transverse distance from side wall 11.

As shown in FIG. 1, side walls 11 are comprised of thee wall parts 10 arranged longitudinally adjacent each other, and transversely extending bracing bars 25 detachably connect the longitudinally extending side walls at upper portions thereof. As shown in FIG. 1, two support bars 13 are arranged at adjoining ends of side wall parts 10. Side walls 11 extend in vertical planes extending perpendicularly with respect to conveyor 7 and, as best shown in FIG. 3, they have lower ends spaced therefrom. Lining 31 of an elastic material is arranged at the inside of side walls 11 between the side walls and conveyor 7. Each lining has a separate lower portion 32 adjacent the conveyor and projecting from the lower side wall ends and an upper portion 33, the lower lining portion being displaceable towards the conveyor. Sheet metal plate 34 bridges a gap between lower and upper lining portions 32, 33, and the sheet metal plate is detachably fastened to side wall 11, loosening of sheet metal plate 34 enabling the lower lining portion to be displaced.

The illustrated freight car is a flat-bed car 3 having swivel trucks 4 supporting loading platform 2 on the track. Supports 8 project downwardly from carrier frame 6 and are detachably connected by screw bolts 9 to loading platform 3 for supporting carrier frame 6 and conveyor 7 on the loading platform. As shown in FIG. 1, supports 8 are of different lengths for supporting carrier frame 6 and conveyor 7 in a longitudinally extending plane extending obliquely with respect to loading platform 3 from a higher end to a lower end. Delivery conveyor band 16 projects beyond end 15 of the loading platform adjacent the higher end and ascends from below the higher end to upper discharge end 18. The delivery conveyor band is pivotal about axis 17 enclosing an angle with the obliquely extending plane. Conveyor band drive 19 is mounted at discharge end 18 of conveyor band 16 to move the conveyor band in a conveying direction indicated by arrow 20. The discharge en of the delivery conveyor band is supported by centering device 21 arranged at an end of the box of like freight car 1 adjacent the lower end of its bottom conveyor. Bottom conveyor 7 comprises elastic, endless conveyor band 35 trained about transversely extending pulleys 30 mounted on carrier frame 6 and drive 22 moves the endless conveyor band in a conveying direction indicated by arrows 20. Another bulk material delivery conveyor band is indicated in phantom lines at the trailing end of freight car 1, as seen in the conveying direction, and this conveyor band delivers bulk material to box 5 either from a like trailing freight car or, for example, waste from a trailing ballast cleaning machine.

Centering device 21 illustrated in FIG. 2 comprises two support rollers 27 transversely spaced from each other a distance corresponding at least to the width of delivery conveyor band 16 and rotatably mounted on side walls 11 of box 5 about transversely extending, horizontal axes 28, each support roller having a flange 29 at a outer end thereof and each flange having a diameter exceeding the diameter of the support roller.

As shown in FIG. 2, box 5 and carrier frame 6 have a width less than the width of loading platform 3 whereby longitudinally extending footpath 2 is formed along the sides of the loading platform.

In building freight cars 1 of the present invention, existing flat-bed cars 3 may be used, the structural unit consisting of box 5, carrier frame 6 and bottom conveyor 7 being mounted on loading platform 2 by screwing carrier frame supports 8 to the loading platform. Delivery conveyor band 16 is also detachably affixed to the loading platform adjacent end 15 thereof. In this manner, a minimum of labor is involved in converting a conventional flat-bed car into the box car of this invention. When lower portion 32 of lining 31 is worn to form an undesirable gap between the lining and the bottom conveyor, clamping sheet metal plate 34 is simply loosened and lower lining portion 32 is displaced downwardly. Thus, box 5 remains sealed at bottom conveyor 7 so that the bulk material in the box cannot flow outwardly through a gap between the lining and the conveyor.

When it is desired to replace a worn endless elastic conveyor band 35 of bottom conveyor 7, transverse braces 25 are detached and side walls 11 are pivoted outwardly about axes 23 into the positions indicated in phantom lines in FIGS. 2 and 3. Since bearings 24 are laterally spaced outwardly from side walls 11, the lower edges of the side walls are thus detached from bottom convéyor 7 so that conveyor band 35 is fully accessible.

FIG. 4 fragmentarily shows freight car 36 constituted by flat-bed car 37 on which is mounted carrier frame 38 for bottom conveyor 39 of box 40. The platform of the flat-bed car also supports a delivery conveyor band (not shown) similar to conveyor band 16 of the above-described embodiment. Also in the same manner as in this embodiment, box 40 is formed by longitudinally extending side walls 41 interconnected by transversely extending end walls 42. Each side wall has a lower portion 43 adjacent bottom conveyor 39 and pivotal about longitudinally extending axis 44. Support bars 46 affix an upper portion 45 of side wall 41 to carrier frame 38 so that the upper portions of the side walls remain stationary. Lower side wall portions 43 extend obliquely with respect to the plane defined by bottom conveyor 39, which is wider than the lower portion of box 40, i.e. the transverse spacing between the lower ends of lower side wall portions 43.

The illustrated centering device 47 comprises two rollers 48 mounted on side walls 41 of the box and extending in a plane extending parallel to that of the delivery conveyor band, rollers 48 being transversely spaced from each other a distance corresponding at least to the width of the delivery conveyor band.

When the conveyor band of bottom conveyor 39 is to be replaced, lower side wall portions 43 are pivoted upwardly out of the way of the conveyor band (see arcuate arrow shown in phantom lines) to make the conveyor band fully accessible. It would also be possible to mount lower side wall portions 43 detachably on support bars 46 of side walls 41 or upper portions 46 of the side walls so that these lower side wall portions may be detached instead of being pivoted out of the way.

What is claimed is:

1. A track-bound flat-bed freight car comprising (a) a loading platform, (b) a box for storing bulk material, the box having a bottom portion and comprising (1) a longitudinally extending conveyor in the bottom portion of the box, (2) a carrier frame bearing the conveyor, and (3) the box carrier frame having a length not exceeding that of the loading platform, (c) supports of different lengths projecting downwardly from the carrier frame for supporting the carrier frame and conveyor on the loading platform in a longitudinally extending plane extending obliquely with respect to the loading platform from a higher discharge end to a lower end, both conveyor ends being in the bottom portion of the box and the higher discharge end being vertically spaced from the loading platform a distance not exceeding half the height of the box, and (d) a delivery conveyor band projecting beyond an end of the loading platform and ascending from a receiving end immediately above the loading platform end and immediately below the higher discharge end of the longitudinally extending conveyor to an upper end.

2. The freight car of claim 1, wherein the delivery conveyor band is pivotal about an axis extending at an angle to the obliquely extending plane.

3. The freight car of claim 2, further comprising a centering device arranged at an end of the box adjacent the lower end for engaging the pivotal delivery conveyor band of a like freight car adjacent thereto.

4. The freight car of claim 3, wherein the centering device comprises two support rollers transversely spaced from each other a distance corresponding at least to the width of the delivery conveyor band and rotatably mounted on the side walls of the box about transversely extending, horizontal axes, each support roller having a flange at an outer end thereof and each flange having a diameter exceeding the diameter of the support roller.

5. The freight car of claim 3, wherein the centering device comprises two rollers mounted on the side walls of the box and extending in a plane extending parallel to that of the delivery conveyor band, the rollers being transversely spaced from each other a distance corresponding at least to the width of the delivery conveyor band.

6. The freight car of claim 2, further comprising a centering device arranged at the upper end of the projecting delivery conveyor band for centering the upper delivery conveyor band end over the box of a like freight car adjacent thereto.

7. The freight car of claim 1, wherein the box and the carrier frame have a width less than the width of the loading platform whereby a longitudinally extending footpath is formed along the sides of the loading platform.

* * * * *